United States Patent [19]

Pollehn et al.

[11] 4,193,011

[45] Mar. 11, 1980

[54] THIN ANTIREFLECTION COATING FOR ELECTRO-OPTICAL DEVICE

[75] Inventors: Herbert K. Pollehn, Alexandria; Jerry L. Bratton, Woodbridge, both of Va.

[73] Assignee: The United States of America as represented by the Secretary of the Army, Washington, D.C.

[21] Appl. No.: 906,711

[22] Filed: May 17, 1978

[51] Int. Cl.[2] ..... H01J 29/28; H01J 1/70

[52] U.S. Cl. ..... 313/94; 313/466; 427/64; 427/74

[58] Field of Search ..... 428/450, 472; 313/105 CM, 466, 94; 427/64, 68, 69, 70, 78, 74

[56] References Cited

U.S. PATENT DOCUMENTS

| | | | |
|---|---|---|---|
| 2,303,563 | 12/1942 | Law | 313/466 |
| 3,280,356 | 10/1966 | Stoudenheimer | 313/99 |
| 3,392,297 | 7/1968 | Schwartz | 313/466 |
| 3,692,576 | 9/1972 | Takayanagi | 427/69 |
| 3,767,447 | 10/1973 | Mizuno | 427/69 |
| 3,772,562 | 11/1973 | Goodrich | 313/105 CM |
| 3,781,089 | 12/1973 | Fay | 428/450 |
| 3,911,165 | 10/1975 | Kanai | 427/68 |
| 4,010,304 | 3/1977 | Cohen | 428/472 |
| 4,031,552 | 6/1977 | Bosserman | 313/105 CM |
| 4,048,039 | 9/1977 | Daxinger | 428/450 |

*Primary Examiner*—John D. Smith

*Attorney, Agent, or Firm*—Nathan Edelberg; Robert P. Gibson; Aubrey J. Dunn

[57] ABSTRACT

An absorbing coating consisting of three layers sequentially deposited on the aluminized phosphor screen of an electro-optical device such as an image intensifier. The layers are: a transparent dielectric layer with a thickness of about one quarter wavelength of radiation to be absorbed, a thin metal semitransparent layer, and an aluminum oxide protective layer for the thin metal layer. The coating is transparent to electrons bombarding the phosphor, but absorbs radiation which might pass through the photocathode and be reflected from the phosphor aluminum coating back to the photocathode. Such reflected radiation can cause spurious output electrons from the photocathode.

10 Claims, 3 Drawing Figures

THIN ANTIREFLECTION COATING FOR ELECTRO-OPTICAL DEVICE

The invention described herein may be manufactured, used, and licensed by the U.S. Government for governmental purposes without the payment of any royalties thereon.

BACKGROUND OF THE INVENTION

The invention is in the field of electro-optical devices and in particular is useful for image intensifiers. Such intensifiers usually include a photocathode onto which a visible-light image to be intensified is projected. The photocathode produces an electron image, and this electron image is focussed onto a microchannel plate (MCP) which functions as an electron multiplier. The MCP thus produces a multiplied electron image of the visible-light image. The electrons of the multiplied electron image are drawn by a high voltage to a phosphor to produce a visible image that is an intensified representation of the original visible-light image. An example of such an intensifier is shown and described in an article in *Electronics* of Sept. 27, 1973, pages 117–124. Alternatively, an earlier embodiment (first generation) of image intensifier included no MCP, but focussed the electron image from its photocathode directly onto an output phosphor. An example of such an intensifier is U.S. Pat. No. 3,280,356 of Oct. 18, 1966. Third generation image intensifiers now being developed use neither an MCP nor a focussing electrode, but each has an output phosphor screen closely adjacent and parallel to a photocathode. With any of these three types of intensifiers, the problem exists of internal reflections within the intensifiers. Such reflections may arise from the usual aluminum layer on the output phosphor or from other internal structures of the intensifiers, such as MCPs or focussing electrodes. The radiation being reflected is that which penetrates the photocathode from the (unintensified) light image side. Such radiation may be reflected back to the photocathode and cause spurious outputs of electrons therefrom. Reflections from the aluminum layer on the output phosphor may be eliminated by covering the aluminum with black antihalation coatings such as black nickel, gold, carbon, or some mixtures of carbon and metallic blacks. However, such coatings have two disadvantages. First, in order to adequately absorb incident radiation, the coatings must be relatively thick; however, a thick coating has poor electron transmissivity. Second, such coatings do not adhere well to the aluminum layer on the phosphor. Another way of eliminating reflections uses several layers of a dielectric material. As with the black antihalation layers, such layers have the disadvantages of poor electron transmissivity. Moreover, the problem of charging of the dielectric exists. Such charging adversely affects device life, and, in severe cases, may cause voltage breakdowns. Further, the thickness of such layers seems to be responsible for gain reductions and noise figure increases in devices so coated. The instant invention is able to provide a thin, non-charging coating relatively transparent to electrons but opaque and absorbing for undesired electromagnetic radiations.

SUMMARY OF THE INVENTION

A nonreflective (absorbing) coating for an electro-optical device and a method of making the same. The coating consists of layers on the aluminum coating of the device phosphor. The layers include: a first layer of a dielectric such as silicon oxide having a thickness of about one quarter wavelength of radiation to be absorbed, and a semitransparent second layer of metal such as aluminum or chromium. A second dielectric layer such as aluminum oxide may be used to cover the metal layer and act as a protective film.

DETAILED DESCRIPTION OF THE INVENTION

Figure 1:
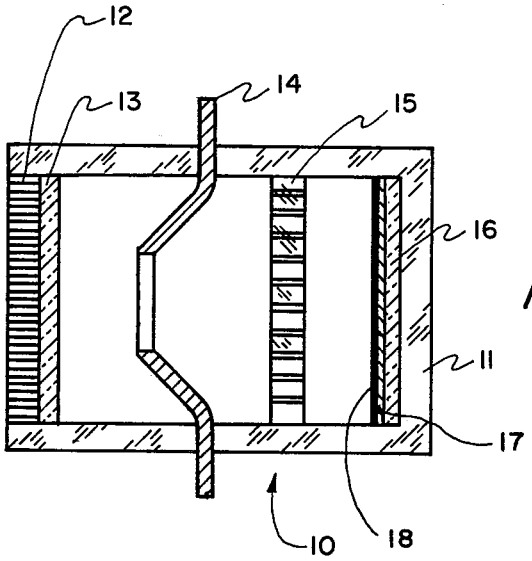
FIG. 1 is a schematic showing of one embodiment of electro-optical device to which the invention is applied.

The invention may perhaps be best understood by referring to the drawings, in which FIG. 1 shows an electro-optical device 10 having glass housing 11, a fiber-optic input surface 12, a photocathode 13, focussing electrode 14, microchannel plate 15, phosphor 16, and aluminum coating 17. Thus far, all of these elements are those conventional in the type of electro-optical device as shown in the *Electronics* article referred to above in the Background of the Invention. It should be understood that various electrical potentials are applied in the usual manner as shown by the said article. Moreover, an objective lens and eyepiece lens would be used with this device. The difference between the device as shown and the usual device lies in a novel antireflection coating 18 on aluminum coating 17.

Figure 2:
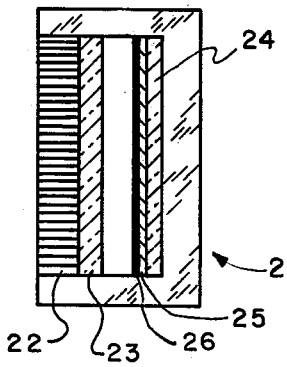
FIG. 2 is a schematic showing of another embodiment of electro-optical device to which the invention is applied.

FIG. 2 shows another electro-optical device 20 including glass housing 21, fiber-optic input surface 22, photocathode 23, phosphor 24, aluminum coating 25, and antireflection coating 26. As described above for the FIG. 1 device, this device would usually be used with an objective lens and an eyepiece lens.

Before we describe coating 18/26, brief description of the operations of devices 10 and 20 may be in order. Device 10 will intensify a visible image projected onto surface 12 by first producing an electron (charge) image on photocathode 13. This charge image is projected by electron lens 14 onto microchannel plate 15. Plate 15 acts as an electron multiplier and produces a multiplied electron image on its right side in the drawings. This multiplied image is proximity focussed onto phosphor 16 to produce an image which is an intensified representation of the original image on fiber-optic surface 12. The operation of device 20 is much simpler than that of 10. A visible image is focussed onto surface 22 and photocathode 23 produces an electron image therefrom. This electron image is proximity focussed onto phosphor 24. The problem which our invention resolves arise from the partial transparency of the photocathodes and/or MCPs in electro-optical devices to various visible light or other radiations falling on the device input surfaces. Any radiations which do penetrate the photocathodes or MCPs may be reflected by focussing electrodes or the like, but most particularly by the aluminum coating on the output phosphor. Such reflections may return to the photocathode and cause it to emit electrons. Obviously, those electrons will cause undesirable outputs from the device output phosphor. Usually, the radiations causing such reflections fall within certain frequency bands. These bands may include the radiation wavelengths of the input image of interest or other wavelengths not of interest, but to which the photocathode may respond.

Figure 3:
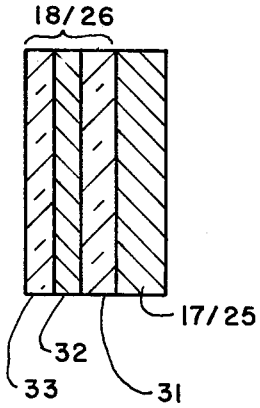
FIG. 3 is a cross sectional showing of the inventive coating, not to scale, on an aluminum layer.

The makeup of antireflection coating 18/26 may be seen in FIG. 3, and includes dielectric layer 31 on aluminum layer 17/25 and metal layer 32. An optional dielectric protective layer 33 may cover layer 32. There are some choices of metals and dielectrics that may be used for the various layers and such choices depend, among other things, on the particular wavelengths of radiation to which the electro-optical device is exposed. A particular set of layers and their thicknesses may be as follows: dielectric, 630Å silicon oxide; metal, 20Å chromium; and optional dielectric, 100Å aluminum oxide. This choice of layers gives a coating having a minimum absorption at about 0.86 μm wavelength. Another particular set of layers may have the same optional dielectric layer, but with a 1120Å silicon oxide dielectric layer at 45Å aluminum metal layer. This set of layers has a maximum absorption at about 1.5 μm wavelength.

METHOD OF MAKING

For an aluminized phosphor screen, heated to 100° C. in a $10^{-6}$ torr vacuum, a typical set of steps for practicing our inventive method is as follows:

evaporate SiO at 25Å/sec. to a 630Å thickness, evaporate Cr at 10Å/sec. to a 20Å thickness, and if a protective layer is used, evaporate $Al_2O_3$ at 15Å/sec. to a 100Å thickness.

This set of layers will give a coating having 100% absorbance at a center wavelength of 0.86 μm.

We claim:

1. An electro-optical device having at least a photocathode capable of producing an electron image from an electromagnetic energy image in a band impinging thereon, and having a phosphor screen juxtaposed to said photocathode and with an aluminum layer on the side of the screen toward said photocathode, whereby an electron image on said photocathode is focussed through said aluminum layer onto said screen to induce a photoimage thereon, the improvement comprising:

a thin dielectric layer on said aluminum layer; and a thin metallic layer on said dielectric layer, whereby the combination of layers is transparent to electrons from said photocathode and absorbent to electromagnetic energy in the band of said electromagnetic energy image.

2. The coating as defined in claim 1 wherein said dielectric layer is transparent to said band and is less than one-quarter wavelength thickness of the center of said band.

3. The coating as defined in either of claim 1 or 2 wherein said metallic layer is transparent to electrons and partially transparent to said band.

4. The coating as defined in claim 3 wherein said dielectric layer is silicon oxide on the order of 630Å thick.

5. The coating as defined in either of claim 1 or 2 wherein said dielectric layer is silicon oxide on the order of 630Å thick.

6. The coating as defined in either of claim 1 or 2 wherein said metallic layer is chromium on the order of 20Å thick.

7. The coating as defined in either of claim 1 or 2 wherein said metallic layer is chromium on the order of 20Å thick and said dielectric layer is silicon oxide on the order of 630Å thick.

8. The coating as defined in either of claim 1 or 2 wherein said metallic layer is chromium on the order of 20Å thick and is transparent to electrons but partially transparent to said band.

9. The coating as defined in either of claim 1 or 2 wherein said metallic layer is chromium on the order of 20Å thick and is transparent to electrons but partially transparent to said band, and wherein said dielectric layer is silicon oxide on the order of 630Å thick.

10. The coating as defined in either of claim 1 or 2 wherein said metallic layer is aluminum on the order of 45Å thick.

* * * * *